US009546066B2

(12) United States Patent
Iwasaki

(10) Patent No.: US 9,546,066 B2
(45) Date of Patent: Jan. 17, 2017

(54) MEDIUM STORAGE AND FEED-OUT DEVICE AND MEDIUM TRANSACTION APPARATUS

(71) Applicant: Oki Electric Industry Co., Ltd., Tokyo (JP)

(72) Inventor: Satoru Iwasaki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 241 days.

(21) Appl. No.: 14/376,934

(22) PCT Filed: Dec. 14, 2012

(86) PCT No.: PCT/JP2012/082568

§ 371 (c)(1),
(2) Date: Aug. 6, 2014

(87) PCT Pub. No.: WO2013/140686

PCT Pub. Date: Sep. 26, 2013

(65) Prior Publication Data

US 2015/0298928 A1 Oct. 22, 2015

(30) Foreign Application Priority Data

Mar. 23, 2012 (JP) ..... 2012-067209

(51) Int. Cl.
*G06K 7/00* (2006.01)
*G06Q 40/00* (2012.01)
(Continued)

(52) U.S. Cl.
CPC ... *B65H 29/006* (2013.01); *B65H 2301/41912* (2013.01); *B65H 2404/743* (2013.01);
(Continued)

(58) Field of Classification Search
CPC ..... B65H 29/006; B65H 3/34; B65H 3/44; B65H 2301/00; B65H 2301/41912; B65H 29/00; G06Q 20/042; G06Q 20/1085; G07F 19/203; G07F 19/20; G07D 11/0057; G07D 11/0081
See application file for complete search history.

(56) References Cited

U.S. PATENT DOCUMENTS 5,850,075 A * 12/1998 Brannan ..... B41J 11/663 235/379
8,302,757 B1 * 11/2012 Angus ..... B65H 5/023 194/206
(Continued)

FOREIGN PATENT DOCUMENTS

EP 2224403 A1 9/2010
JP 2000-255826 A 9/2000
(Continued)

OTHER PUBLICATIONS

Russian Office Action dated Oct. 7, 2015 with English Translation.
Japanese Office Action with translation dated May 7, 2015.

*Primary Examiner* — Thien T Mai
(74) *Attorney, Agent, or Firm* — Rabin & Berdo, P.C.

(57) ABSTRACT

A temporary holding section winds banknotes onto an outer peripheral face of a circular, cylinder-shaped and rotatably supported drum to retain the banknotes between a facing portion and the outer peripheral face. More specifically, the temporary holding section uses an upper side tape and a lower side tape, that respectively have one end wound onto the drum, such that accompanying rotation of the drum, the supplied banknotes are sandwiched between the tapes and the outer peripheral face. Moreover, in the temporary holding section, a movable section that presses the banknote against the drum outer peripheral face while being movable
(Continued)

with respect to the drum is positioned with the other end further away from the drum than the facing portion.

7 Claims, 13 Drawing Sheets

(51) Int. Cl.
*G06K 5/00* (2006.01)
*B65H 29/00* (2006.01)

(52) U.S. Cl.
CPC ..... *B65H 2404/7414* (2013.01); *B65H 2404/7431* (2013.01); *B65H 2701/1912* (2013.01)

(56) References Cited

U.S. PATENT DOCUMENTS

| | | | | |
|---|---|---|---|---|
| 2008/0203649 | A1* | 8/2008 | Watase | B65H 3/44 271/9.13 |
| 2008/0211171 | A1* | 9/2008 | Kusumi | B65H 3/44 271/225 |
| 2010/0163571 | A1* | 7/2010 | Mizoro | B65H 29/006 221/71 |
| 2011/0079675 | A1 | 4/2011 | Iwatsuki et al. | |
| 2011/0227273 | A1* | 9/2011 | Osaki | B65H 5/36 271/10.09 |

FOREIGN PATENT DOCUMENTS

| | | | |
|---|---|---|---|
| JP | 2010-001123 | A | 1/2010 |
| WO | WO-2009/050796 | A1 | 4/2009 |

* cited by examiner

MEDIUM STORAGE AND FEED-OUT DEVICE AND MEDIUM TRANSACTION APPARATUS

TECHNICAL FIELD

The present invention relates to a medium storage and feed-out device and a medium transaction apparatus that are, for example, well suited for application to an Automated Teller Machine (ATM) input with a medium, such as banknotes, to perform desired transactions.

BACKGROUND ART

Hitherto, automated teller machines, such as those employed in financial institutions, allow a customer to pay in cash, such as coins or banknotes, and pay out cash to a customer, according to the contents of a customer transaction.

An example of technology proposed for such an automated teller machine includes a banknote pay-in/pay-out port that accepts and dispenses banknotes for a customer, a classification section that classifies the denomination and authenticity of inserted banknotes, a temporary holding section that temporarily holds inserted banknotes, and denomination cassettes that store banknotes by denomination.

In this automated teller machine, when a customer has inserted banknotes into the banknote pay-in/pay-out port in a pay-in transaction, the inserted banknotes are classified in the classification section. The automated teller machine then holds banknotes classified as normal banknotes in the temporary holding section, and banknotes that are classified as unsuitable for use in the transaction are replaced in the banknote pay-in/pay-out port and returned to the customer. Then, when the customer has approved the pay-in amount, the automated teller machine reclassifies the banknotes held in the temporary holding section by denomination in the classification section, and the banknotes are stored in the respective denomination cassettes according to their classified denomination.

As an example of such a temporary holding section, technology is proposed that includes a circular, cylinder-shaped rotating drum and a pair of long tapes that mutually face each other. One end of each of the tapes is fixed to an outer peripheral face of the drum such that the tapes overlap with each other (see for example Japanese Patent Application Laid-Open (JP-A) No. 2010-1123).

FIG. 10 to FIG. 12 illustrate an example of a temporary holding section 115. Respective components of the temporary holding section 115 are attached to a temporary holding section casing 120.

Moreover, in the temporary holding section 115, both sides of banknotes BL (see FIG. 13) conveyed in sequence, for example from a classification section, are sandwiched, at a central portion in a left-right direction thereof that is orthogonal to the conveyance direction of the banknotes BL, between an upper side tape 33 and a lower side tape 36, whilst the banknotes BL are guided by a movable guide 141. The temporary holding section 115 rotates a drum 31, winding the banknotes BL onto an outer peripheral face of the drum 31 in this state, so as to temporarily hold the banknotes BL in a space between an inside face 120E of the temporary holding section casing 120 and the outer peripheral face of the drum 31.

The movable guide 141 swings about a pivot shaft 45 to follow changes in the thickness of the banknotes BL wound onto the drum 31. As a result, a gap SP opens up between a leading end portion on the left side of the movable guide 141 in FIG. 12 and the inside face 120E of the temporary holding section casing 120.

DISCLOSURE OF INVENTION

Technical Subject

Banknotes BL are sometimes torn from an edge portion when circulating in the marketplace. In the temporary holding section 115, sometimes a banknote BL with a tear from an edge portion is dispensed after having been taken up on the drum 31. When dispensing such a banknote BL, the banknote BL is sometimes conveyed in a state in which the tear runs along the conveyance direction at a position displaced in the banknote BL width direction with respect to the upper side tape 33 and the lower side tape 36.

When feeding out the banknote BL from the drum 31 in such a conveyance state, as illustrated in FIG. 13, an outside portion in the width direction from the tear of the banknote BL can lift and curl up accompanying rotation of the drum 31. The curled up portion of the banknote BL can enter the gap SP between the movable guide 141 and the inside face 120E of the temporary holding section casing 120 and cause what is referred to as a paper jam, thereby lowering the reliability of banknote BL conveyance.

In consideration of the above circumstances, the present invention proposes a medium storage and feed-out device and a medium transaction apparatus capable of significantly raising medium conveyance reliability.

Solution Addressing Subject

In order to address the above issue, a medium storage and feed-out device of the present invention includes: a circular, cylinder-shaped drum that is rotatably supported, and that winds a paper, sheet-shaped medium onto an outer peripheral face of the drum to retain the medium between the outer peripheral face of the drum and a facing portion that faces the outer peripheral face of the drum; a tape that has one end wound onto the drum outer peripheral face, and that, accompanying rotation of the drum, is wound with the medium supplied from the outside through an entry/exit hole on the drum outer peripheral face while the medium is sandwiched between the tape and the drum outer peripheral face; and a movable section, one end thereof being provided at the vicinity of the entry/exit hole, and the other end thereof extending to the vicinity of the drum, the movable section pressing the medium against the drum outer peripheral face while being movable with respect to the drum, with the other end of the movable section positioned further away from the drum than the facing portion.

This medium storage and feed-out device enables preventing the medium from entering a gap, due to conveying the medium so as to follow the movable section and the facing portion.

A medium transaction apparatus of the present invention includes: a customer interface that accepts transactions relating to a paper, sheet-shaped medium; a conveyance section that conveys the medium accepted by the customer interface; circular, cylinder-shaped drum that is rotatably supported, and that winds the medium onto an outer peripheral face of the drum to retain the medium between the outer peripheral face and a facing portion that faces the outer peripheral face; and a tape that has one end wound onto the drum outer peripheral face, and that, accompanying rotation of the drum, is wound with the medium supplied from the outside through an entry/exit hole on the drum outer peripheral face while the medium is sandwiched between the tape and the drum outer peripheral face; and a movable section, one end thereof being provided at the vicinity of the entry/exit hole, and the other end thereof extending to the vicinity of the drum, the movable section pressing the medium against the drum outer peripheral face while being movable with respect to the drum, with the other end of the movable section positioned further away from the drum than the facing portion.

This medium transaction apparatus enables preventing the medium from entering a gap due to conveying the medium so as to follow the movable section and the facing portion.

Advantageous Effects of Invention

According to the present invention, the medium can be prevented from entering a gap, due to conveying the medium so as to follow the movable section and the facing portion. The present invention accordingly enables a medium storage and feed-out device and a medium transaction apparatus capable of significantly raising medium conveyance reliability to be achieved.

BEST MODE FOR CARRYING OUT THE INVENTION

Explanation follows regarding an exemplary embodiment of the present invention (referred to below as the exemplary embodiment), with reference to the drawings.

1. Exemplary Embodiment 1-1. Automated Teller Machine Overall Configuration

Figure 1:
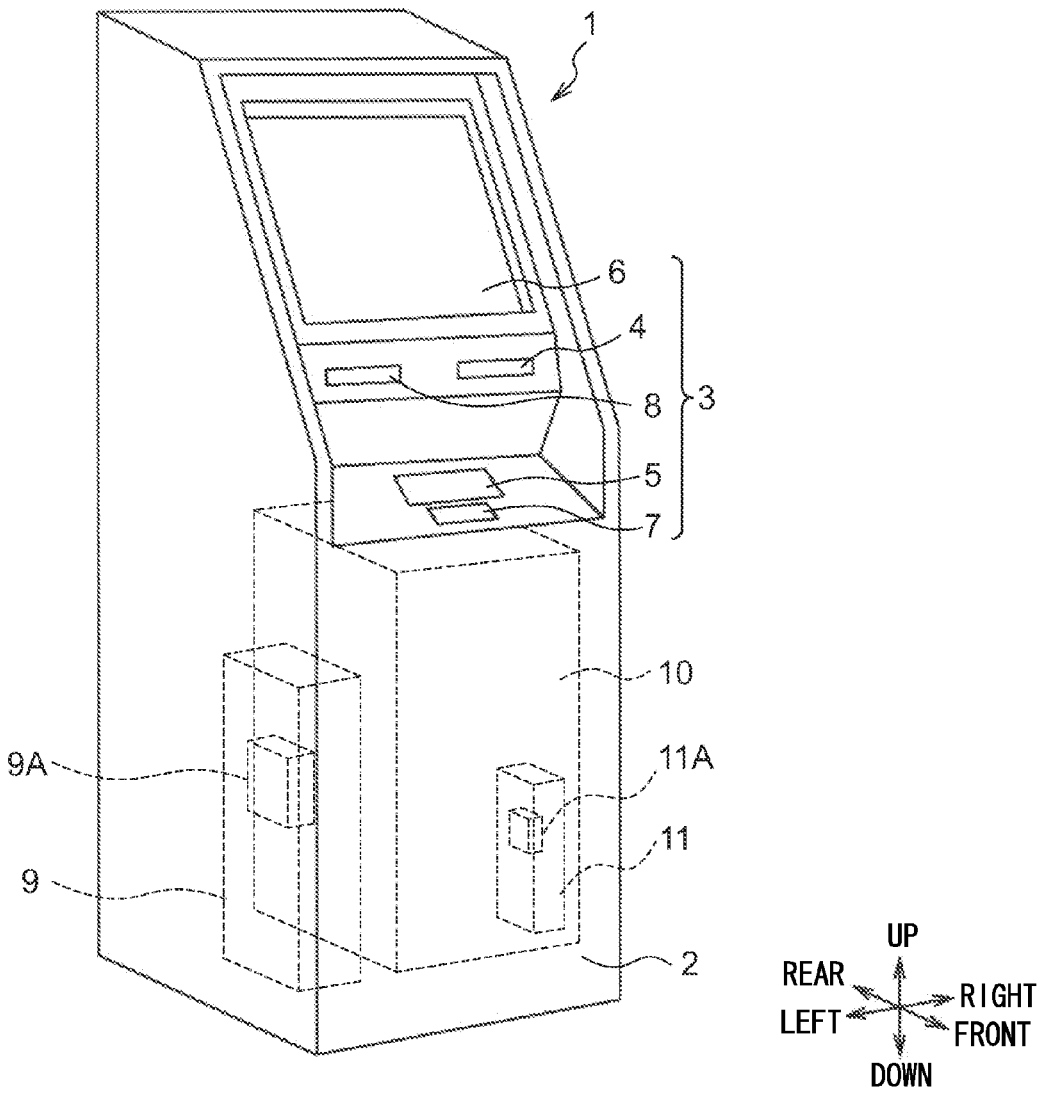
FIG. 1 is a perspective view illustrating configuration of an automated teller machine, showing a front face, left side face and upper face.

As illustrated in the external view of FIG. 1, an automated teller machine 1 serving as an example of a medium transaction apparatus includes a box shaped casing 2. The automated teller machine 1 is installed in, for example, a financial institution, and is configured to perform cash transactions, such as pay-in transactions and pay-out transactions, with a customer.

The casing 2 is configured with a diagonal cut-away shape at a location, namely at a portion spanning from a front face upper portion to the top face of the casing 2, enabling easy insertion of a banknote serving as an example of a medium and easy operation of a touch panel by a customer facing the front side of the casing 2. The casing 2 is provided with a customer interface 3 at the portion spanning from the front face upper portion to the top face of the casing 2.

The customer interface 3 is configured to directly handle cash and passbook transactions with a customer, as well as to notify transaction-related information and receive operation instructions. The customer interface 3 is provided with, for example, a card insertion/removal port 4, a pay-in/pay-out port 5, an operation display section 6, a ten-key 7, and a receipt issue port 8.

The card insertion/removal port 4 is a section for the insertion and return of various cards, such as cash cards. A card processor (not illustrated in the drawings) that reads, for example, account numbers magnetically recorded on the various cards is provided behind the card insertion/removal port 4.

The pay-in/pay-out port 5 is a section into which banknotes for paying in are inserted by a customer, and where banknotes for paying out to a customer are dispensed. The pay-in/pay-out port 5 is opened up, or closed off, by driving a shutter. The banknotes are, for example, configured by rectangular shaped paper.

The operation display section 6 is integrated with a Liquid Crystal Display (LCD) that displays operation screens during transactions, and a touch panel that is input with, for example, a transaction type selection, a PIN, and a transaction amount.

The ten-key 7 is a physical keypad that receives input of the numbers 0 to 9. The ten-key 7 is used during PIN and transaction amount input operations.

The receipt issue port 8 is a section that issues a receipt printed with, for example, transaction details at the end of transaction processing. A receipt processor (not illustrated in the drawings) that prints the transaction details on the receipt is, for example, provided behind the receipt issue port 8.

In the following explanation of the automated teller machine 1, the front side is defined as the side facing a customer, and the rear side is defined as the opposite side to the front side. Moreover, in the explanation of the automated teller machine 1, the left side, right side, upper side and lower side are defined from the perspective of left and right as seen by a customer facing the front side.

A main controller 9 that performs integrated control of the overall automated teller machine 1, and a banknote pay-in/pay-out device 10 serving as an example of a medium storage and feed-out device that performs various processing relating to banknotes, are provided inside the casing 2.

The main controller 9 includes a Central Processing Unit (CPU), not illustrated in the drawings. The main controller 9 reads and executes specific programs from, for example, Read Only Memory (ROM) or flash memory, not illustrated in the drawings, to perform various processing in pay-in transactions and pay-out transactions.

Inside the main controller 9 is a storage section 9A configured by, for example, Random Access Memory (RAM), a hard disk drive, or flash memory. The main controller 9 stores various data in the storage section 9A.

Open-and-closable doors are provided, for example, at portions of side faces, such as on the front face side or rear face side of the casing 2. Namely, as illustrated in FIG. 1, during cash transaction operations with customers, the respective doors are closed such that the banknotes stored inside the banknote pay-in/pay-out device 10 are protected by the casing 2. However, during a maintenance operation performed by an operator, the respective doors in the casing 2 are opened as required, enabling easy completion of tasks on each internal portion.

Figure 2:
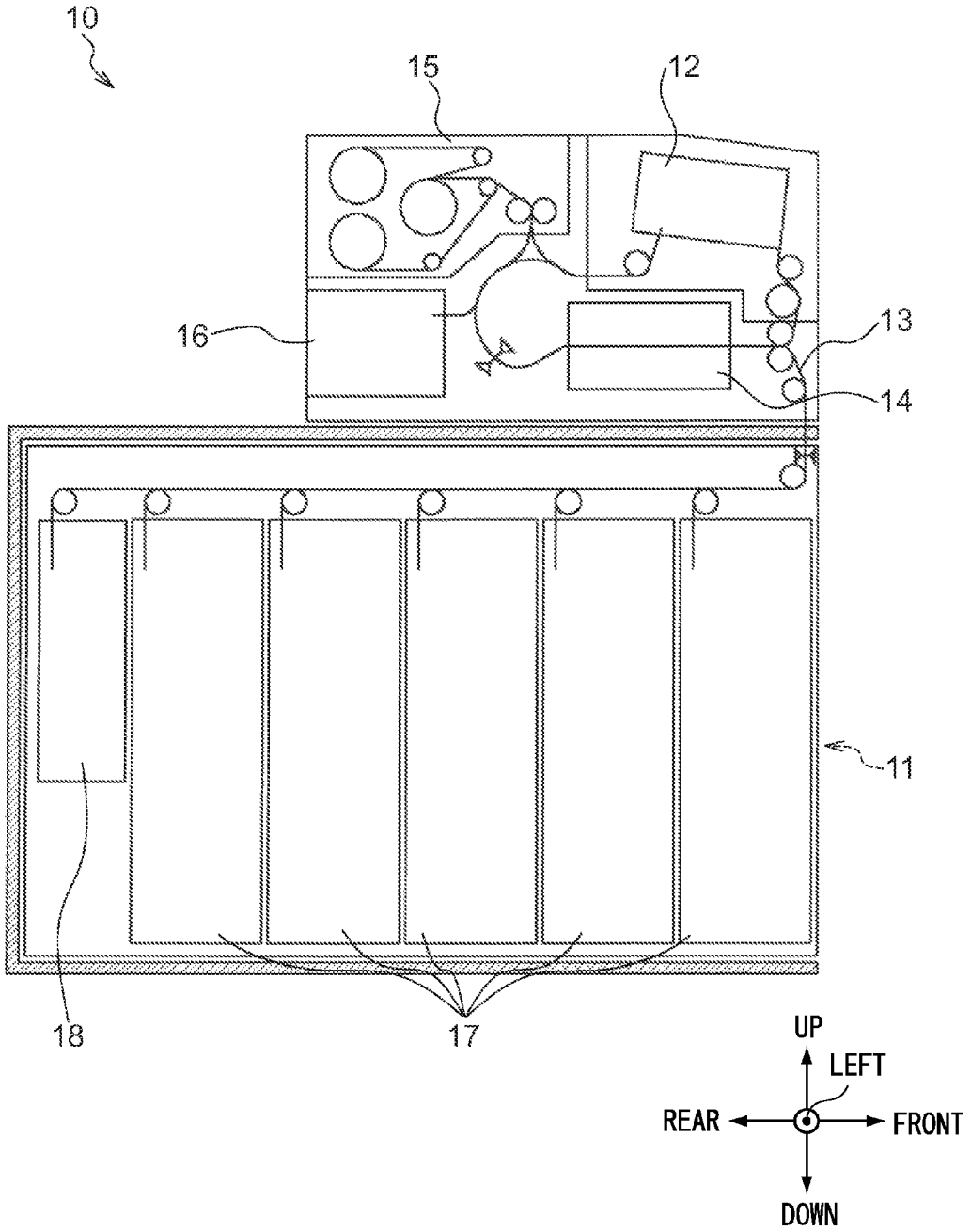
FIG. 2 is a left hand side view of configuration of a banknote pay-in/pay-out device.

As illustrated in the side view of FIG. 2, the banknote pay-in/pay-out device 10 is configured by a combination of plural sections that perform various processing relating to banknotes. Each section of the banknote pay-in/pay-out device 10 is controlled by a banknote controller 11.

The banknote controller 11 includes a CPU, not illustrated in the drawings, similarly to the main controller 9 (see FIG. 1). The banknote controller 11 reads and executes specific programs, such as from ROM or flash memory, not illustrated in the drawings, in order to perform various processing, such as processing to decide a banknote conveyance destination.

Inside the banknote controller 11 is a storage section 11A (see FIG. 1) configured by, for example, RAM and flash memory. The banknote controller 11 stores various data in the storage section 11A.

In, for example, a pay-in transaction in which a customer pays in banknotes, after receiving specific operation input through the operation display section 6, the banknote controller 11 opens the pay-in/pay-out port 5 shutter to allow insertion of banknotes into a pay-in/pay-out section 12.

When banknotes have been inserted, the pay-in/pay-out section 12 closes the pay-in/pay-out port 5 shutter and then takes the banknotes out one note at a time, passing the banknotes to a conveyance section 13. The conveyance section 13 conveys the banknotes, configured by rectangular shaped sheets of paper, to a classification section 14, in a direction in which the short edge of the banknotes runs along the direction of travel (banknote landscape orientation).

As the banknotes are conveyed inside the classification section 14, optical devices and/or magnetic detection devices, for example, classify the banknotes, for example according to denomination, authenticity, and degree of wear. The classification section 14 moreover notifies the banknote classification results to the banknote controller 11. The banknote controller 11 accordingly decides the conveyance destination of a banknote based on the acquired classification results.

Once the conveyance destination of a banknote has been decided, then the conveyance section 13 conveys banknotes that the classification section 14 has classified as normal banknotes to a temporary holding section 15 where they are temporarily held. The conveyance section 13 conveys any reject banknotes, classified as unsuitable for transaction use, to the pay-in/pay-out section 12. The reject banknotes are then returned to the customer.

Next, the banknote controller 11 prompts the customer to approve the pay-in amount using the operation display section 6, and the conveyance section 13 conveys the banknotes held in the temporary holding section 15 to the classification section 14. The banknote controller 11 then prompts the classification section 14 to classify the banknotes according to, for example, denomination and degree of wear, and acquires the banknote classification results.

The banknote controller 11 uses the conveyance section 13 to convey banknotes with a heavy degree of wear for storage in a reject cassette 16 as banknotes that are unsuitable for reuse. The banknote controller 11 moreover uses the conveyance section 13 to convey banknotes with a light degree of wear to the classification section 14 as banknotes for reuse, and the classification section 14 reclassifies the banknotes.

The conveyance section 13 conveys banknotes classified as normal banknotes by the classification section 14 for storage according to denomination in banknote cassettes 17. The conveyance section 13 also conveys banknotes classified as unsuitable for transaction use to a retrieval box 18.

1-2. Temporary Holding Section Configuration

Figure 3:
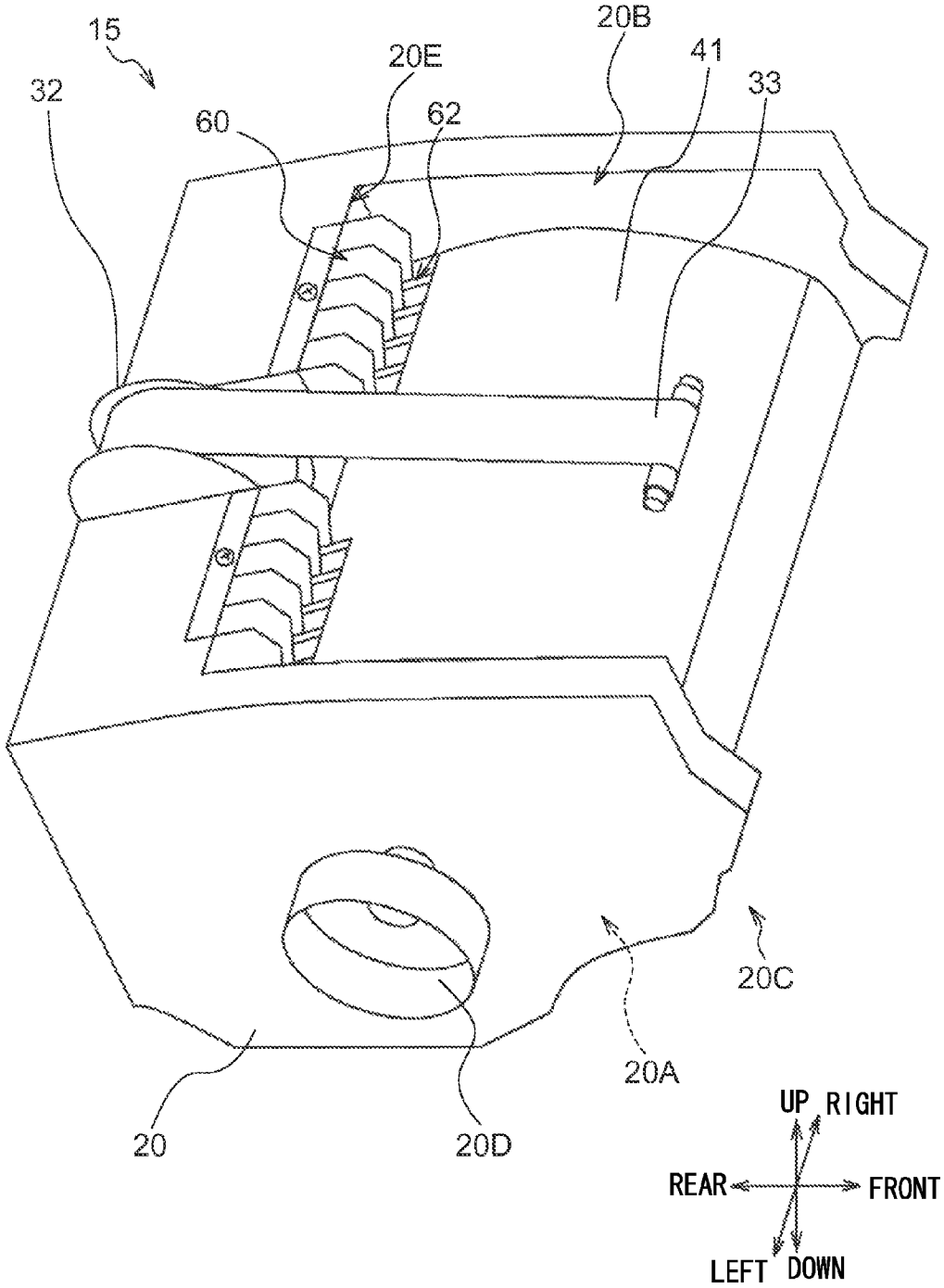
FIG. 3 is a perspective view illustrating an external configuration of a temporary holding section, showing a left side face and an upper face.
Figure 4:
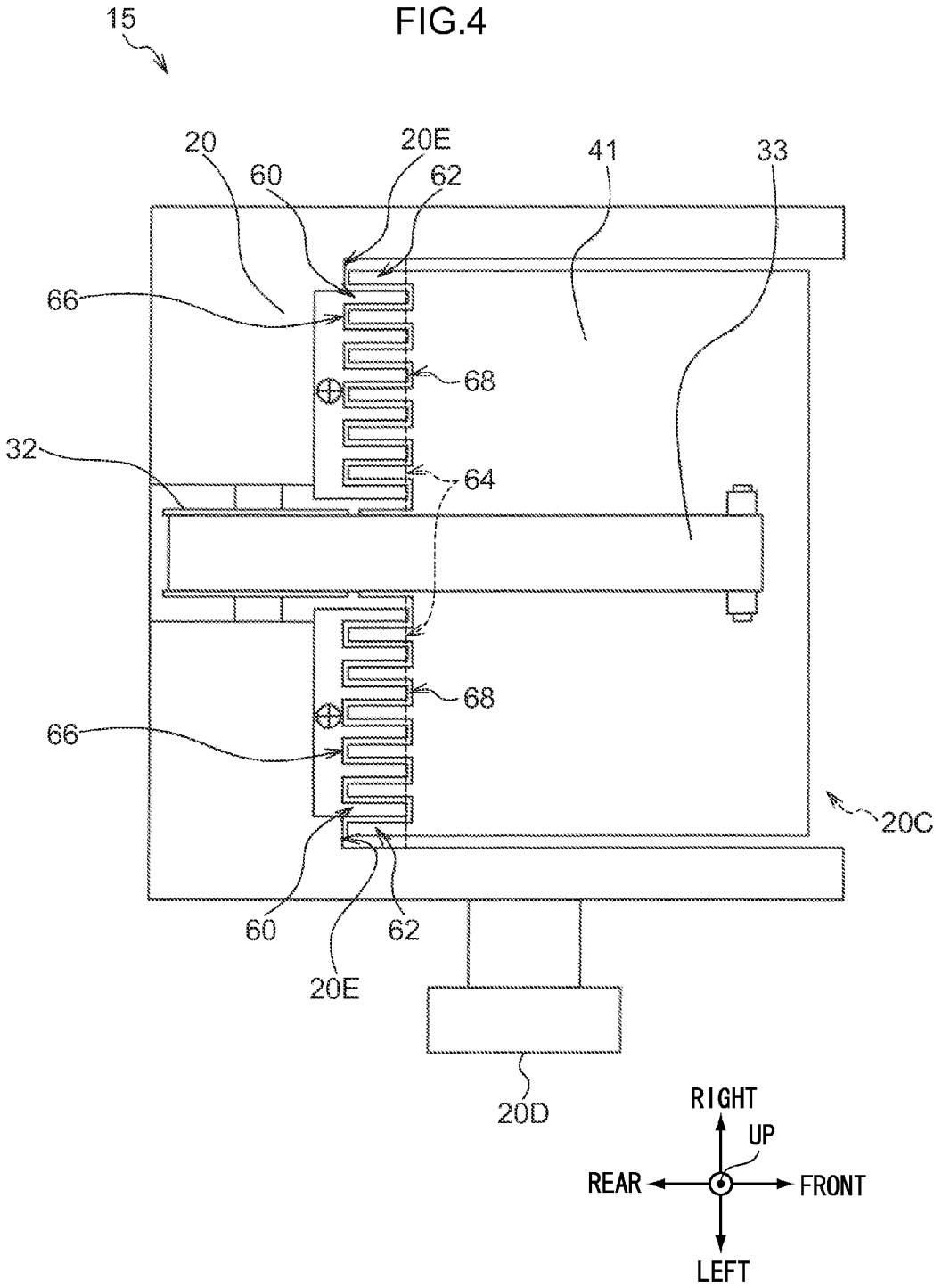
FIG. 4 is a plan view illustrating an external configuration of a temporary holding section.

As illustrated in the external views of FIG. 3 and FIG. 4, the temporary holding section 15 is configured with respective components attached to a temporary holding section casing 20.

The temporary holding section casing 20 is formed with an internal space 20A, surrounded with walls over most of the main front side, rear side, left side, right side, and lower side outer peripheral portions. A banknote entry/exit hole 20C serving as an example of a banknote entry and exit port to the internal space 20A is provided below the front side face of the temporary holding section casing 20.

The temporary holding section casing 20 is configured with an open portion 20B where an upper side outer peripheral wall is omitted, through which the internal space 20A can be accessed from the outside.

Between the left side and right side walls of the temporary holding section casing 20, gears, for example, are installed to transmit drive force from a motor, not illustrated in the drawings, to components including a drum and rollers, described later. Moreover, the left side face of the temporary holding section casing 20 is provided with an operation knob 20D for manual rotation of the drum and rollers during a maintenance operation.

1-2-1. Drum and Tape Moving System Configuration

Figure 5:
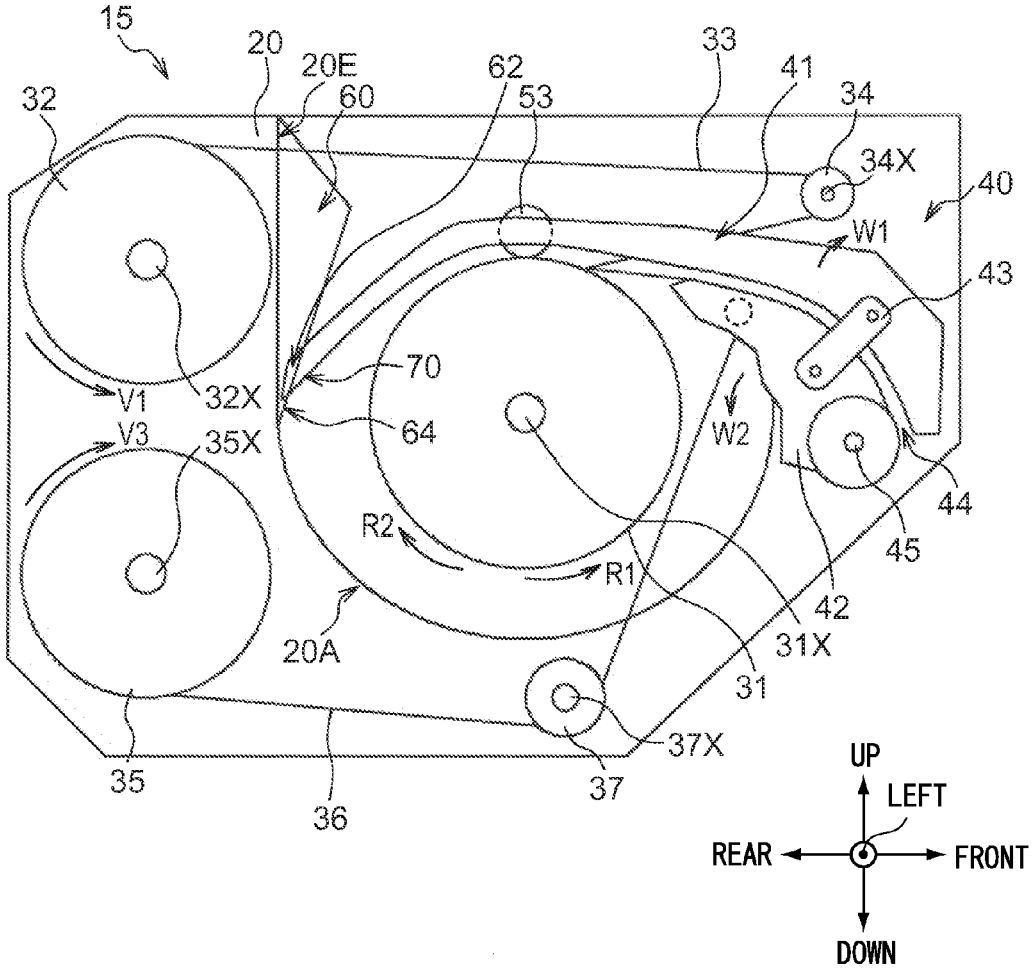
FIG. 5 is a left hand side view of an internal configuration of a temporary holding section in a thinnest state of holding.

As illustrated in FIG. 5, a drum 31 of comparatively large radius is configured in a circular cylinder shape. The drum 31 is attached to a rotation shaft 31X that runs along the left-right direction in the internal space 20A (see FIG. 3) of the temporary holding section casing 20, such that the drum 31 is rotatable in a take-up direction R1 and a feed-out direction R2.

Figure 6:
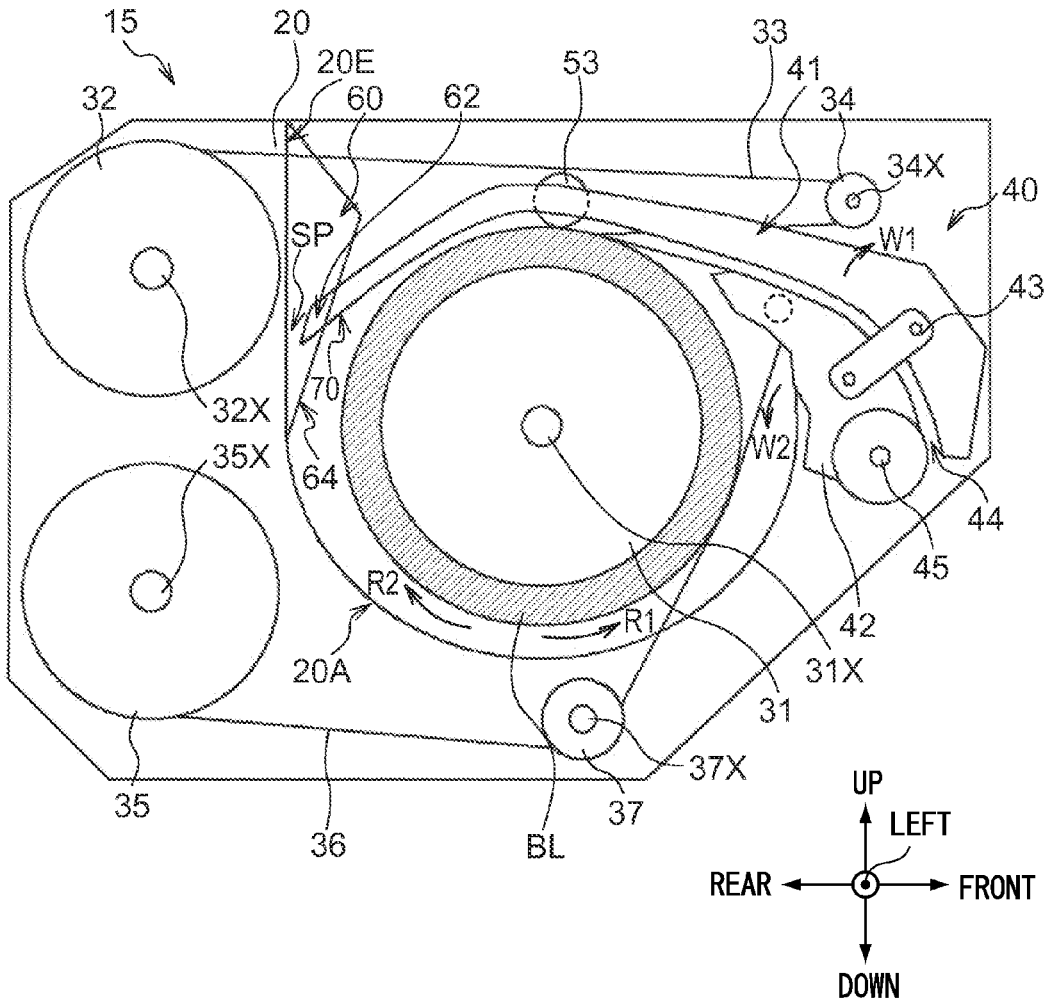
FIG. 6 is left hand side view of an internal configuration of a temporary holding section in a thickest state of holding.

FIG. 5 illustrates a state in which minimum quantity of banknotes are wound onto the drum 31 according to design of the apparatus, such that the apparent external diameter of the drum 31 is at its smallest (referred to below as the thinnest state). FIG. 6 illustrates a state in which maximum quantity of banknotes are wound onto the drum 31 according to the design of the apparatus, such that the apparent external diameter of the drum 31 is at its largest (referred to below as the thickest state).

Two tapes, an upper side tape 33 and a lower side tape 36, are driven in the temporary holding section 15.

An upper side reel 32 is configured in a bobbin shape. The upper side reel 32 is disposed to the upper side of the drum 31, namely toward the rear on the open portion 20B (see FIG. 3) side and at a substantially central location in the left-right direction. The upper side reel 32 is moreover provided so as to rotate about a rotation shaft 32X that runs parallel to the rotation shaft 31X of the drum 31.

The upper side tape 33, serving as an example of a tape, is wound onto the upper side reel 32. The upper side tape 33 is configured by a resin in a thin film shape, has a tape width sufficiently shorter than the long edge of a banknote, and has sufficient length in the length direction.

An upper side roller 34 that is formed with a circular cylinder shape smaller than the upper side reel 32 is provided to the front side of the drum 31, namely on the banknote entry/exit hole 20C (see FIG. 3) side, as viewed from the upper side reel 32.

The axial direction length of the upper side roller 34 is formed longer than the tape width of the upper side tape 33. The upper side roller 34 is moreover rotatable about a rotation shaft 34X that runs parallel to the rotation shaft 31X of the drum 31.

The upper side tape 33 is pulled out from the upper side reel 32 so as to span across the open portion 20B (see FIG. 3) toward the front, before being pulled around the upper side roller 34 to run back toward the lower in a rear direction.

The upper side tape 33 is then pressed against the drum 31 by a specific roller provided to a movable guide 41, described later. A leading end portion of the upper side tape 33 is fixed to the drum 31.

A tension spring, not illustrated in the drawings, biases the upper side reel 32 toward a take-up direction V1 that is a direction to take up the upper side tape 33. The temporary holding section 15 is accordingly configured to always impart a specific tension to the upper side tape 33.

A lower side reel 35 is configured in a bobbin shape similarly to the upper side reel 32. The lower side reel 35 is disposed at a location below the upper side reel 32, namely at a location below and toward the rear of the drum 31. The lower side reel 35 is provided so as to be rotatable about a rotation shaft 35X that runs parallel to the rotation shaft 31X of the drum 31.

The lower side tape 36, configured similarly to the upper side tape 33, is wound onto the lower side reel 35.

A tension spring, not illustrated in the drawings, biases the lower side reel 35 toward a take-up direction V3 that is a direction to take up the lower side tape 36. The temporary holding section 15 is accordingly configured to always impart a specific tension to the lower side tape 36.

The take-up direction V3 of the lower side tape 36 at the lower side reel 35 is the opposite direction to the take-up direction V1 of the upper side tape 33 at the upper side reel 32.

A lower side roller 37 is provided in front of the lower side reel 35 so as to rotate about a rotation shaft 37X that runs parallel to the rotation shaft 31X of the drum 31.

The lower side roller 37 is configured in a circular cylinder shape similarly to the upper side roller 34. The left-right direction length of the lower side roller 37 is moreover longer than the tape width of the lower side tape 36, with the lower side roller 37 disposed at a substantially central location in the left-right direction.

The lower side tape 36 is pulled out from the lower side reel 35 and spans toward the front, before being pulled around the lower side roller 37 to continue upwards. Then, after being directed toward the rear direction around a specific roller provided to a medium guide 42, described later, the lower side tape 36 is pressed against the drum 31. A leading end portion of the lower side tape 36 is fixed to the drum 31.

The leading end of the lower side tape 36 is fixed to an outer peripheral face of the drum 31. The leading end of the upper side tape 33 overlaps with the outer peripheral side of the lower side tape 36 so as to be fixed to the outer peripheral face of the drum 31.

Due to the above configuration, in the temporary holding section 15, when the drum 31 is rotated in the take-up direction R1, the lower side tape 36 and the upper side tape 33 are wound onto the outer peripheral face of the drum 31 so as to overlap with each other.

When this is performed, a banknote in the temporary holding section 15 is sandwiched between the lower side tape 36 and the upper side tape 33, and wound onto the outer peripheral face of the drum 31 together with the lower side tape 36 and the upper side tape 33. The temporary holding section 15 thereby, with this winding operation, retains banknotes in a space between the outer peripheral face of the drum 31 and an inside face 20E of the temporary holding section casing 20.

1-2-2. Movable Guide Configuration

A movable section 40 is configured by the upper side movable guide 41 and the lower side medium guide 42, coupled together by a coupling portion 43. A conveyance path 44 that is configured by a gap sufficiently wider than the thickness of a banknote is formed between the movable guide 41 and the medium guide 42.

The medium guide 42 is formed in a teardrop shape or a wedge shape in side-on profile viewed from the left or right, with a pivot shaft 45 passing through the lower front side of the medium guide 42 in the left-right direction. Upper front sides of the left and right inside faces of the temporary holding section casing 20 (see FIG. 3) are provided with pivot holes (not illustrated in the drawings) corresponding to the pivot shaft 45.

With the pivot shaft 45 attached so as to be inserted through the pivot holes in the temporary holding section casing 20, the medium guide 42 is capable of pivoting about the pivot shaft 45 in an opening direction W1 or a closing direction W2 (see FIG. 5) with respect to the temporary holding section casing 20.

The movable guide 41 is formed overall in a curved plate shape so as to cover the drum 31 from the upper side at the open portion 20B formed at the upper side of the temporary holding section casing 20 (see FIG. 3).

Namely, as illustrated in FIG. 5, the movable guide 41 is formed with a substantially flat plane shaped lower face at a central portion, covering a range substantially from a front side portion of the drum 31 to a rear side portion of the medium guide 42. Moreover, a rear side portion of the movable guide 41 covering the rear side of the drum 31 has a lower face formed with a shape dropping downwards on progression toward the rear side so as to form a circular arc with a greater radius of curvature than the outer peripheral face of the drum 31. Moreover, a front side portion of the movable guide 41 facing a front side portion of the medium guide 42 has a lower face configured with a curved shape that drops down on progression toward the front side so as to follow the profile of the upper face of the medium guide 42, namely so as to form the conveyance path 44.

The movable guide 41 is provided with a wind-on roller 53 in the vicinity of an upper edge of the drum 31, at a position substantially directly above the rotation shaft 31X passing through the drum 31. The wind-on roller 53 is configured in a circular cylinder shape, disposed with a lower side exposed from the lower face of the movable guide 41, and penetrated by a shaft in the left-right direction to render the wind-on roller 53 rotatable.

A force, due to gravity in practice, acts in the closing direction W2 on the movable section 40 causing the wind-on roller 53 at the lower side of the movable guide 41 to contact the outer peripheral face of the drum 31. Therefore, as the drum 31 rotates, the movable guide 41 is able to guide banknotes gripped between the upper side tape 33 and the lower side tape 36 by pressing the banknotes against the outer peripheral face of the drum 31 whilst smoothing out the banknotes along the long edge direction. Note that although there is some concern that the banknotes gripped between the upper side tape 33 and the lower side tape 36 might become creased along the long edge direction, only a central portion of each of the banknotes is gripped between the upper side tape 33 and the lower side tape 36.

The apparent external diameter of the drum 31 increases in thickness as several banknotes are sequentially wound on. The movable guide 41 of the movable section 40 is gradually lifted upwards by the drum 31 accompanying the increase in the drum 31 apparent external diameter, and swings toward the opening direction W1 about the pivot shaft 45.

Due to the movable guide 41 swinging in the opening direction W1, the wind-on roller 53 in the movable guide 41 of the movable section 40 is able to maintain constant contact with the drum 31. The movable section 40 is moreover able to make the conveyance direction, and conveyance destination, of the banknotes follow the outer peripheral face of the drum 31.

When banknotes are inserted to the conveyance path 44 from the front side, the movable section 40 configured as described above is able to place banknotes in contact with the outer peripheral face of the drum 31 in the vicinity of the upper edge of the outer peripheral face of the drum 31, with the banknotes sandwiched between the upper side tape 33 and the lower side tape 36.

In the temporary holding section 15, the drum 31 is rotated in the take-up direction R1 with the banknotes in the sandwiched state between the upper side tape 33 and the lower side tape 36. The temporary holding section 15 is accordingly capable of winding the banknotes onto the outer peripheral face of the drum 31 sandwiched between the upper side tape 33 and the lower side tape 36.

1-2-3. Guide Claw and Casing Claw Configuration

As illustrated in FIG. 4, a rear end upper portion of the inside face 20E of the temporary holding section casing 20 is provided with casing claws 60 that each have a specific width along the left-right direction and serve as facing claws. Plural of the casing claws 60 are provided projecting toward the front at specific intervals along the left-right direction.

The casing claws 60 have a substantially triangular profile in side view (see FIG. 6), increasing in front-rear direction length on progression from bottom to top.

In the following explanation, a hypothetical plane arising due to disposing the plural casing claws 60 side-by-side in the left-right direction is referred to as the facing portion 64. The facing portion 64 is imaginary formed spanning at front edges of the plural casing claws 60 and faces the outer peripheral face of the drum 31.

Namely, in plan view (see FIG. 4), at an upper portion of the inside face 20E at the rear of the temporary holding section casing 20, portions where the casing claws 60 are not formed (referred to below as casing claw recessed portions 66) configure shapes recessed from the facing portion 64 toward the rear.

The rear edge of the movable guide 41 is formed with plural guide claws 62 that project out toward the rear and serve as an example of movable section claws. More specifically, in plan view (see FIG. 4) the plural guide claws 62 have substantially the same left-right direction width as the casing claws 60. The plural guide claws 62 are provided to the rear edge of the movable guide 41 with substantially the same left-right direction intervals between each other as the intervals between the casing claws 60.

In plan view, portions (referred to below as guide claw recessed portions 68) at the rear edge of the movable guide 41 where the guide claws 62 are not formed, accordingly configure recessed shapes from the rear edge of the movable guide 41 toward the front.

The guide claws 62 are formed with a narrower left-right direction width than the width of the casing claw recessed portions 66. The casing claws 60 are formed with a narrower width than the width of the guide claw recessed portions 68.

The guide claws 62 and the casing claws 60 are therefore in a fitted together and enmeshed state, with play therebetween. The rear edge of the movable guide 41 is positioned to the rear of the facing portion 64, namely further away from the drum 31 than the facing portion 64.

In the following explanation, a hypothetical plane arising due to disposing the plural guide claws 62 side-by-side in the left-right direction is referred to as the guide leading end plane 70. The guide leading end plane 70 are imaginary formed at the front ends of the plural guide claws 62 and faces the outer peripheral face of the drum 31.

Figure 7:
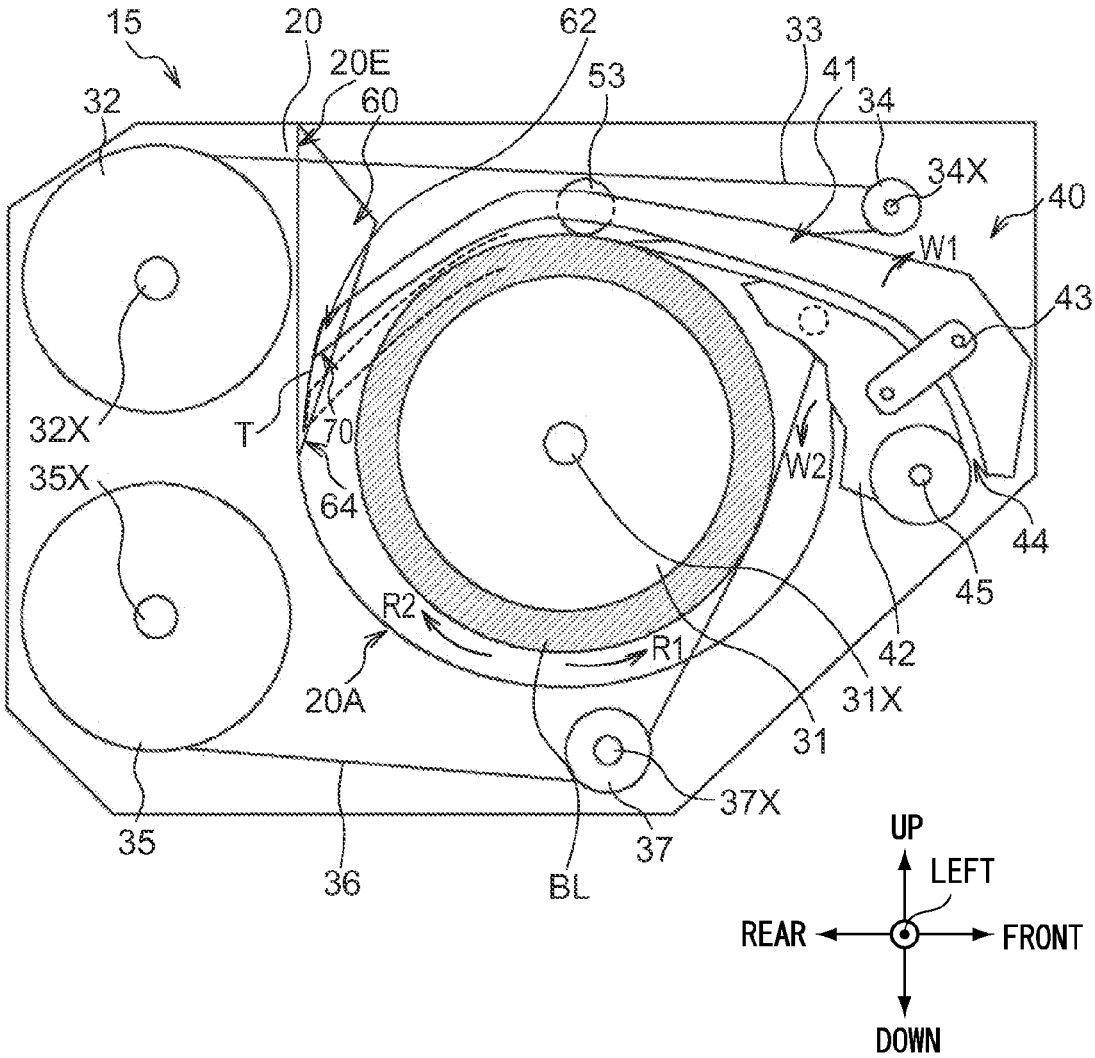
FIG. 7 is a schematic drawing illustrating the trajectory of a movable guide from the thinnest state to the thickest state.

Moreover, during the transition from the thinnest state illustrated in FIG. 5 to the thickest state illustrated in FIG. 7, the movable guide 41 swings about the pivot shaft 45, accompanying the change in thickness of the banknotes BL wrapped onto the drum 31. The rear end of the movable guide 41 (guide claws 62) accordingly moves upwards whilst moving slightly toward the front along the trajectory T illustrated in FIG. 7. In FIG. 7, the guide claws 62 in the thinnest state are illustrated by a broken line.

As described above, the casing claws 60 are configured in side view such that their front-rear direction length increases on progression from bottom to top.

Accordingly, the enmeshed state between the guide claws 62 and the casing claws 60 is always maintained in the temporary holding section 15 throughout the transition from the thinnest state to the thickest state.

Figure 8:
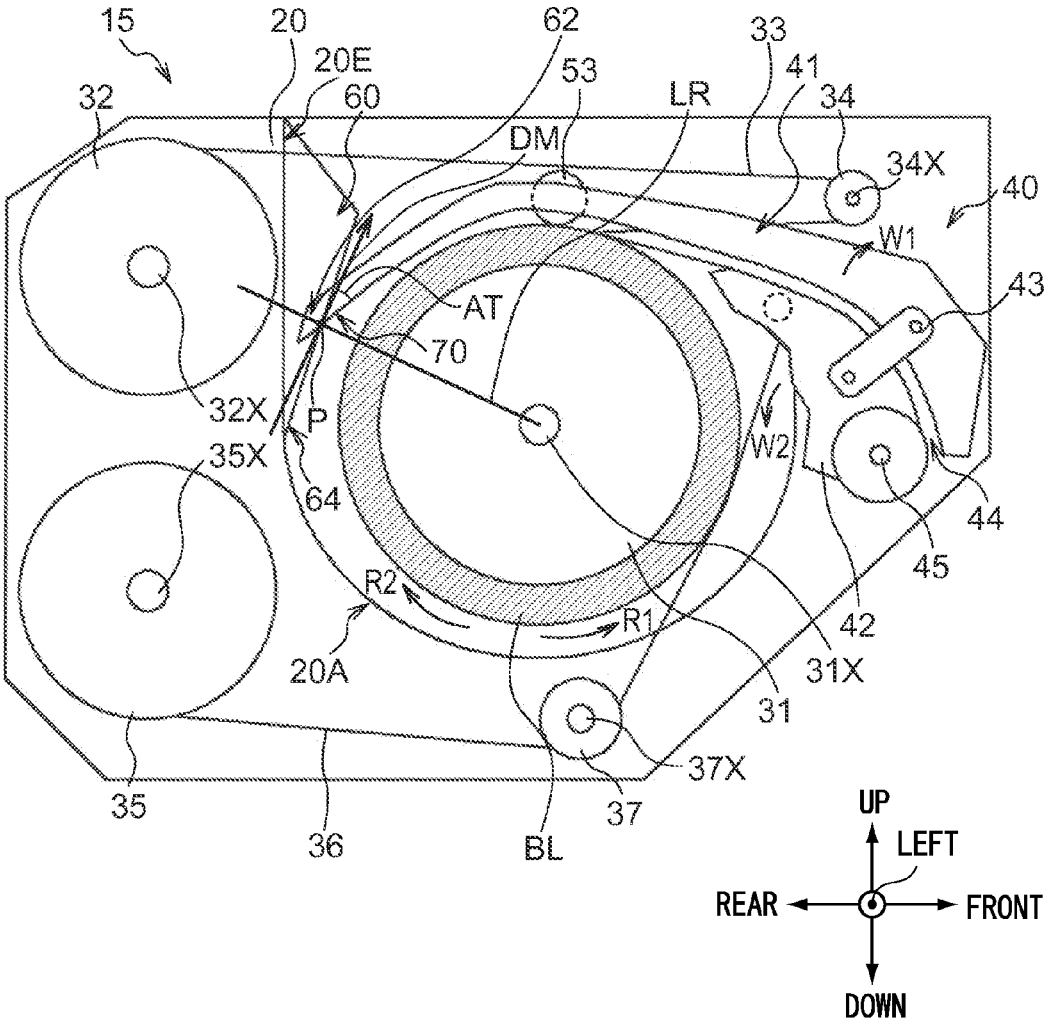
FIG. 8 is a schematic drawing illustrating a guide leading end angle.

Moreover, as illustrated in FIG. 8, in the thickest state, a hypothetical line, denoted radial direction line LR, extends from the center of the rotation shaft 31X toward an intersection point P, that is a portion where the guide leading end plane 70 intersects with the facing portion 64.

A direction orthogonal to the radial direction line LR at the intersection point P, which direction substantially follows the feed-out direction R2, is the direction of travel DM of the leading edge of a banknote BL as the banknote BL is being fed out from the drum 31.

An angle formed between the guide leading end plane 70 of the guide claws 62 and the direction of travel DM at the intersection point P (referred to below as the guide leading edge angle AT) is set at from 0 degrees to 30 degrees.

1-3. Operation and Advantageous Effects

As illustrated in FIG. 5, in order to feed out the banknotes BL, the temporary holding section 15 configured as described above rotates the drum 31 in the feed-out direction R2, and respectively rotates the upper side reel 32 and the lower side reel 35 in the take-up direction V1 and the take-up direction V3. The upper side tape 33 and the lower side tape 36 are accordingly taken up onto the upper side reel 32 and the lower side reel 35.

The temporary holding section 15 thereby peels the banknotes BL away from the outer periphery of the drum 31 and feeds the banknotes BL to the outside through the conveyance path 44.

Figure 9:
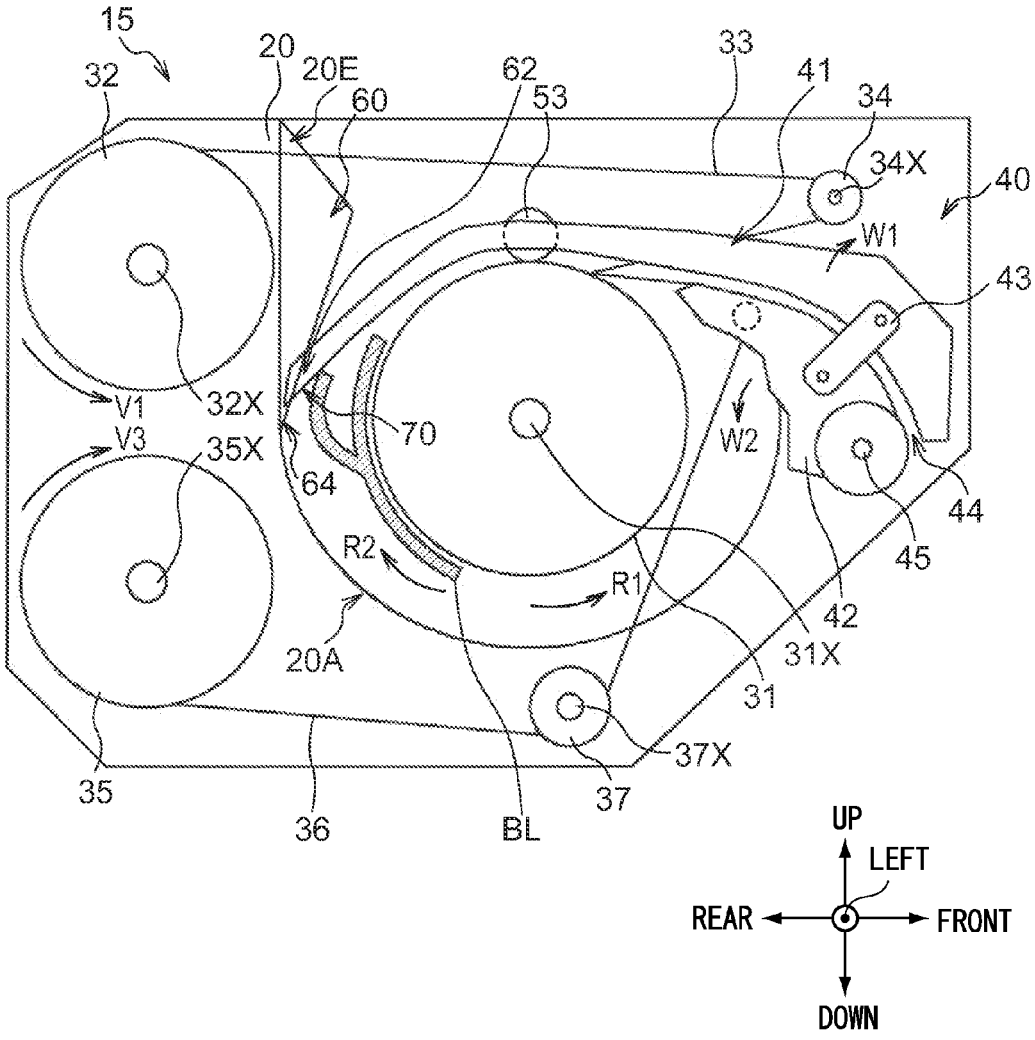
FIG. 9 is a left hand side view illustrating a state in which a banknote is being fed out from a drum.
Figure 10:
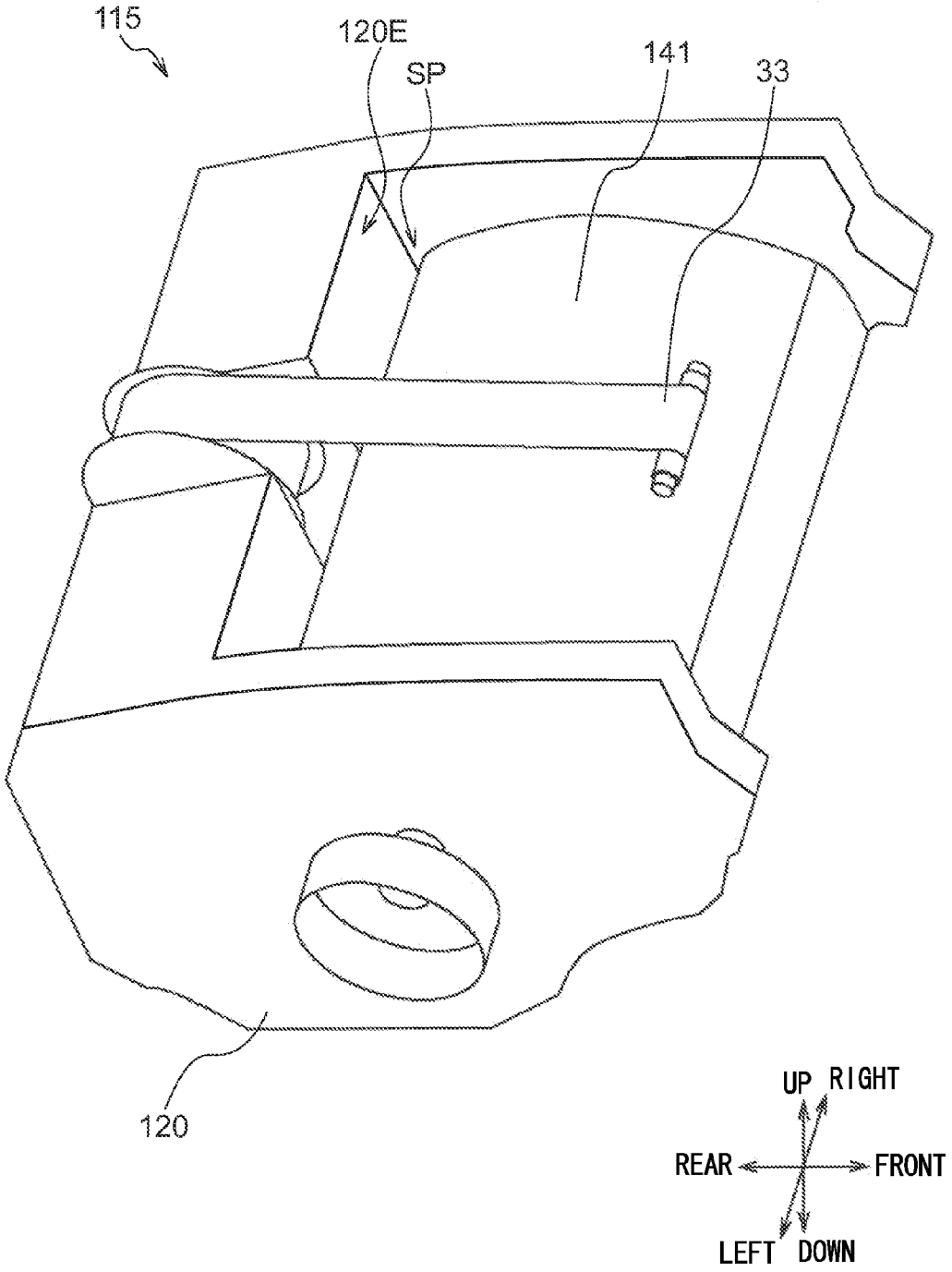
FIG. 10 is a perspective view illustrating an external configuration of a conventional temporary holding section, showing a left side face and an upper face.
Figure 11:
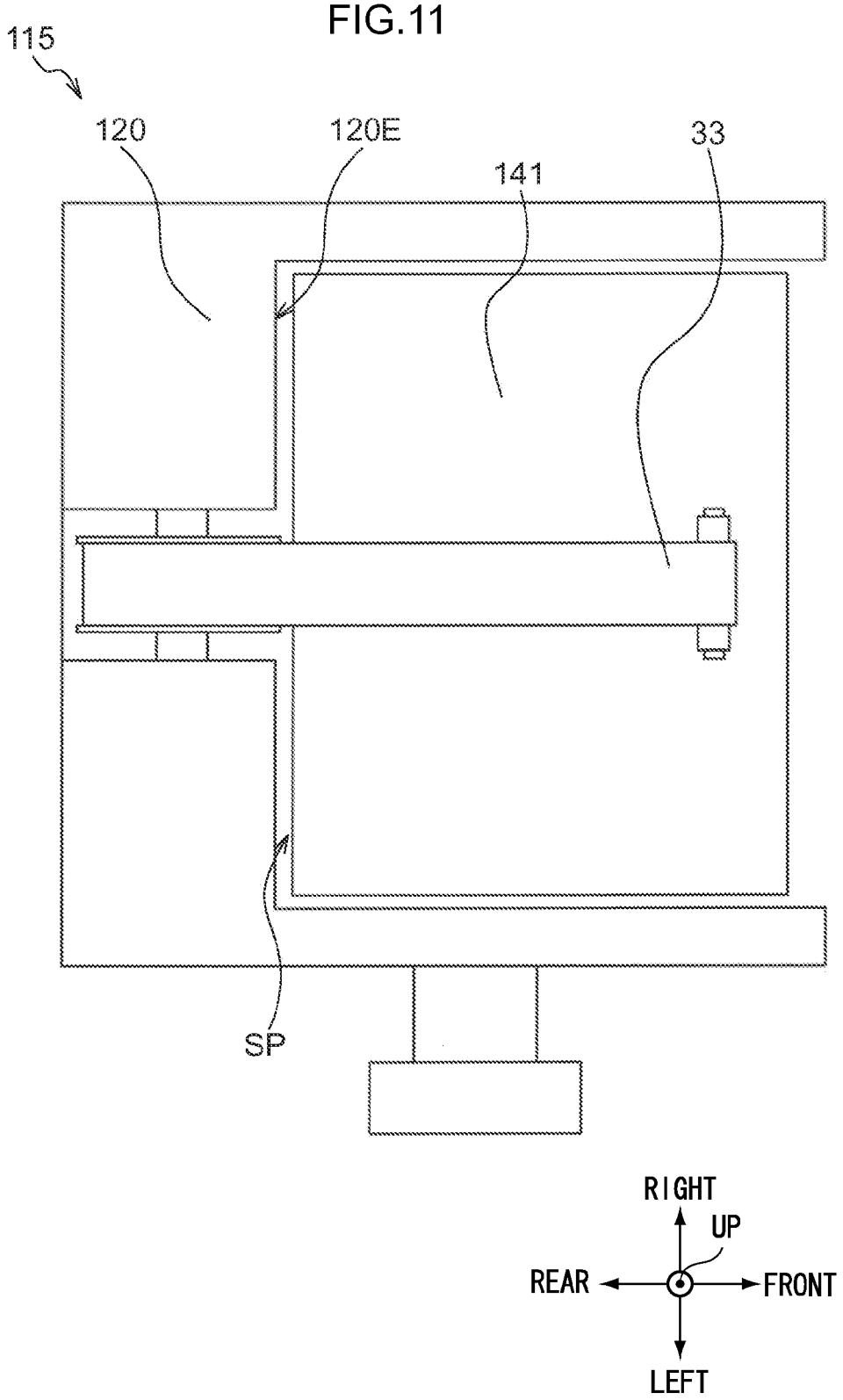
FIG. 11 is a plan view illustrating an external configuration of a conventional temporary holding section.
Figure 12:
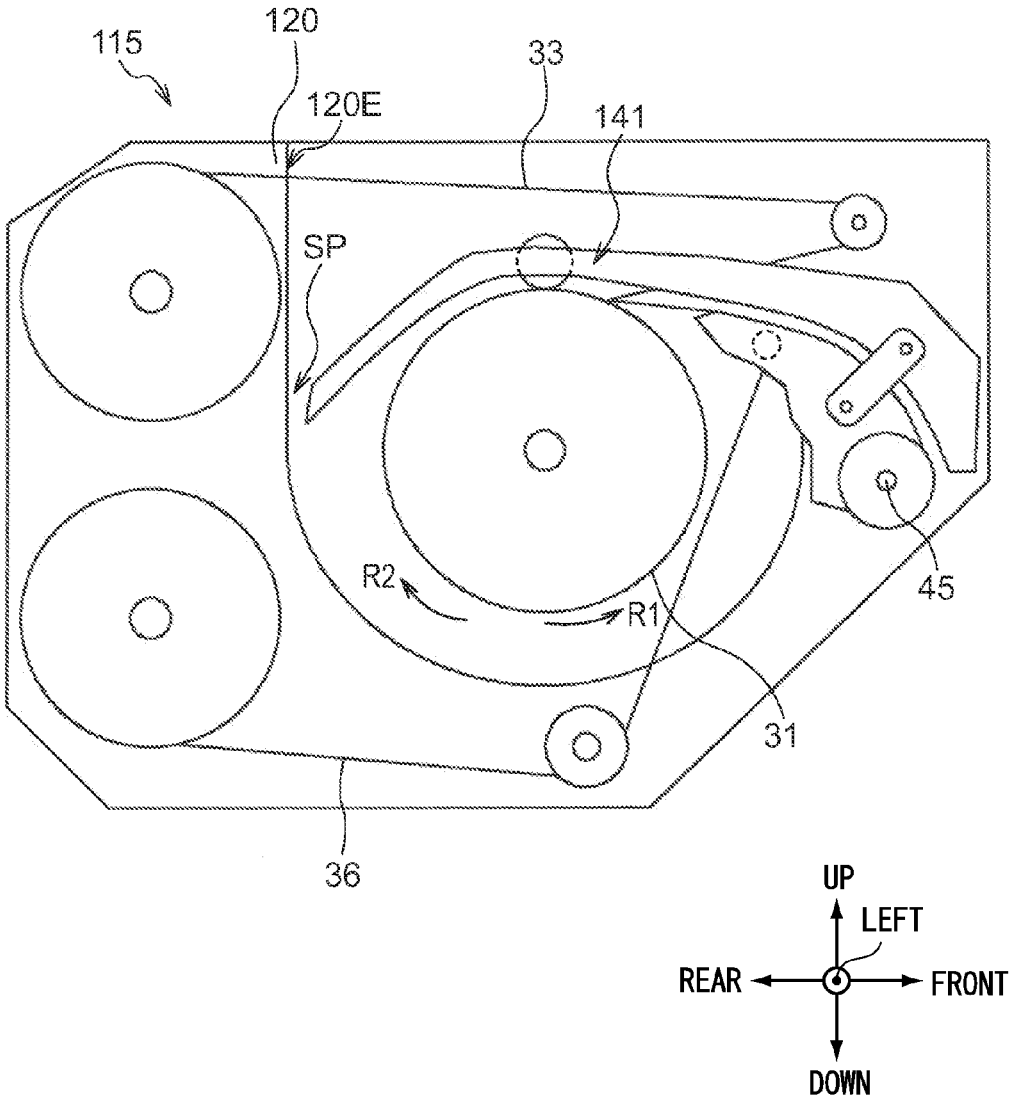
FIG. 12 is a left hand side view of an internal configuration of a conventional temporary holding section.
Figure 13:
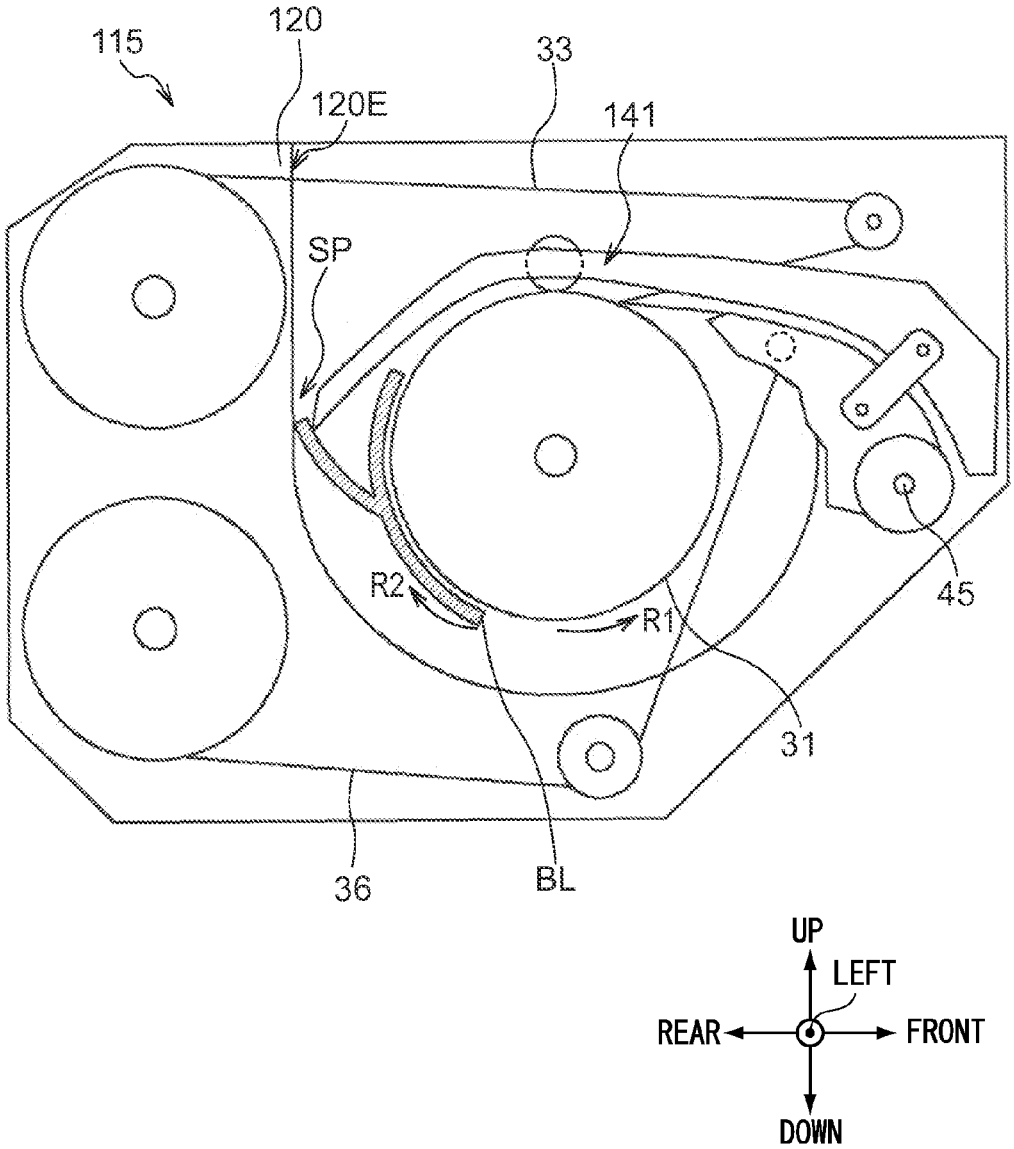
FIG. 13 is a left hand side view illustrating a state in which a banknote is being fed out from a drum in a conventional temporary holding section.

When considering a case in which a banknote BL with a tear, running along the conveyance direction, at the width direction outside of the upper side tape 33 and the lower side tape 36 is conveyed in the temporary holding section 15, as illustrated in FIG. 9, a portion of the banknote BL at outside of the tear in the width direction might lift and curl up accompanying the rotation of the drum 31.

The guide claws 62 and the casing claws 60 are enmeshed along the left-right direction at intervals sufficiently shorter than the long edge direction length of the banknotes. The portion of the conveyed banknote BL is accordingly suppressed from curling up as it follows the facing portion 64 of the casing claws 60 and the guide leading end plane 70 of the movable guide 41 and is fed out.

The temporary holding section 15 is accordingly capable of feeding out the banknote BL without the banknote BL entering between the movable guide 41 and the temporary holding section casing 20, even when a portion of the banknote BL has curled up.

Note that generally, in the event that a travelling banknote contacts a peripheral object and is changed the direction of travel, the banknote can still be conveyed normally, without the leading edge buckling, as long as the banknote leading edge is shifted at angle of within 30 degrees from the direction of travel (referred to below as the buckling threshold angle).

Moreover, the guide claws 62 move along the trajectory T that follows a circular arc with respect to the substantially flat plane shaped facing portion 64. The guide leading edge angle AT (see FIG. 8) accordingly increases on progression from the thinnest state toward the thickest state.

Namely, when the banknotes BL are being fed out, the leading edges of the banknotes BL get closer to a buckling-prone state on progression from the thinnest state toward the thickest state.

However, the guide leading edge angle AT in the thickest state is set at the buckling threshold angle or lower in the temporary holding section 15.

Accordingly, the temporary holding section 15 is able to feed banknotes out smoothly and without buckling, even in the thickest state.

Moreover, the guide claws 62 and the casing claws 60 are in an enmeshed state in the temporary holding section 15. The temporary holding section 15 is accordingly able to guide the banknotes BL without the banknotes BL entering a gap between the guide claws 62 and the temporary holding section casing 20 as the banknotes BL are being taken up onto the drum 31.

Note that a banknote BL that has been torn at a portion which is gripped between the upper side tape 33 and the lower side tape 36 can also be suppressed from curling up.

The casing claws 60 and the guide claws 62 are therefore not formed at the back side of the upper side tape 33 in plan view (see FIG. 4).

In comparison to the conventional temporary holding section 115, additional components in the temporary holding section 15 can accordingly be suppressed to a minimum.

According to the above configuration, in the temporary holding section 15, the banknotes BL are wound onto the outer peripheral face of the drum 31 which is circular, cylinder-shaped and is rotatably supported whereby the banknotes BL are retained between the outer peripheral face and the facing portion 64 that faces the outer peripheral face. In the temporary holding section 15, the upper side tape 33 and the lower side tape 36, that each have one end wound onto the outer peripheral face of the drum 31, are, accompanying the rotation of the drum 31, wound onto the outer peripheral face, with the banknotes BL that have been supplied from the outside of the temporary holding section casing 20 through the banknote entry/exit hole 20C are sandwiched between the tapes and the outer peripheral face of the drum 31. Moreover, in the temporary holding section 15, the movable section 40, one end thereof is provided at the vicinity of the banknote entry/exit hole 20C and the other end thereof extends to the vicinity of the drum 31. The movable section 40, that presses the banknotes BL against the outer peripheral face of the drum 31 while being capable of moving with respect to the drum 31, is positioned such that the other end of the movable section 40 is further away from the drum 31 than the facing portion 64.

The temporary holding section 15 is accordingly able to prevent the banknotes BL from entering a gap between the inside face 20E of the temporary holding section casing 20 and the movable section 40 since the banknotes BL are conveyed following the casing claws 60 and the guide claws 62. The temporary holding section 15 can accordingly prevent banknote BL jams, greatly increasing the reliability of banknote BL conveyance.

2. Other Exemplary Embodiments

Note that in the exemplary embodiment described above, explanation is given regarding a case in which the casing claws 60 and the guide claws 62 are of a uniform width, and are formed at uniform intervals along the left-right direction.

The present invention is not limited thereto, and, for example, the casing claws 60 and the guide claws 62 may be configured so as to increase in width, with increasing intervals therebetween, on progression from left-right direction end portions toward a central portion. In such cases, the wider the width of the casing claws 60 and the guide claws 62, the more the strength of the casing claws 60 and the guide claws 62 can be raised. The casing claws 60 and the guide claws 62 can accordingly be made less susceptible to damage, even when an operator touches the casing claws 60 and the guide claws 62 during removal of banknotes BL from the internal space 20A.

Moreover, in the exemplary embodiment described above, explanation is given regarding a case in which a single pair of the upper side tape 33 and the lower side tape 36 are provided in the temporary holding section 15.

The present invention is not limited thereto, and the temporary holding section 15 may be provided with two or more pairs of upper tapes and lower tapes. In such cases, when a banknote BL has a tear positioned at the width direction outside of the two pairs of upper tapes and lower tapes, portion at the outside of the tear of the banknote BL is liable to curl up. However, even in such cases, the temporary holding section 15 is capable of feeding out the banknote BL without the banknote BL entering between the movable guide 41 and the temporary holding section casing 20.

Moreover in the exemplary embodiment described above, the open portion 20B is provided at the upper side of the temporary holding section casing 20 and the movable section 40 is disposed at the upper side of the drum 31. In the exemplary embodiment described above, explanation is given regarding a case in which the movable guide 41 of the movable section 40 is pressed against the outer peripheral face of the drum 31 by the action of gravity.

However, the present invention is not limited thereto, and the open portion 20B may be disposed at the front side, rear side, or lower side of the temporary holding section casing 20 with the movable section 40 disposed to the front side, rear side, or lower side of the drum 31 so as to cover the open portion 20B. The movable guide 41 of the movable section 40 may moreover be pressed against the outer peripheral face of the drum 31 by the action of a biasing means, such as a spring.

Moreover, in the exemplary embodiment described above, explanation is given regarding a case in which the temporary holding section 15 winds the banknotes BL onto the outer peripheral face of the drum 31 in a state gripped between the upper side tape 33 and the lower side tape 36.

The present invention is not limited thereto, and, for example, the lower side tape 36 and its associated mechanism may be omitted from the temporary holding section 15, with a face of the upper side tape 33 that contacts the banknotes BL configured with adhesive properties. Namely, the banknotes BL may be wound onto the outer peripheral face of the drum 31 with the upper side tape 33 that overlaps the outer peripheral side of the banknotes BL after the banknotes BL are in a temporarily affixed state to the upper side tape 33 due to the adhesive properties of contacting face of the upper side tape 33.

Moreover, in the exemplary embodiment described above, explanation is given regarding a case in which the present invention is applied to the temporary holding section 15 of the automated teller machine 1.

However, the present invention is not limited thereto, and, for example, the present invention may be applied to various devices in which banknotes BL are temporarily held wound onto a drum 31, sandwiched between an upper side tape 33 and lower side tape 36, such as a device that performs only classification or only counting of banknotes.

Moreover, in the exemplary embodiment described above, explanation is given regarding a case in which the banknotes BL serving as a medium are held in the temporary holding section 15 of the automated teller machine 1 that performs cash transactions with a customer in, for example, a financial institution.

However, the present invention is not limited thereto, and, for example, the present invention may be applied to a temporary holding section incorporated in an accounting system used by a cashier to perform various cash-related processing, such as in a financial institution. The present invention may also be applied to various devices that hold a paper, sheet-shaped medium, such as shopping vouchers, cash vouchers, or entrance tickets. In such cases, the tape width and number of the upper side tape 33 and the lower side tape 36 may be set as appropriate according to the size and shape of the medium.

Moreover, in the exemplary embodiment described above, explanation is given regarding a case in which the temporary holding section 15 serving as an example of a medium storage and feed-out device includes: the drum 31 serving as an example of a drum; the upper side tape 33 and the lower side tape 36 serving as examples of tapes; and the movable section 40 serving as an example of a movable section.

However, the present invention is not limited thereto, and the medium storage and feed-out device may be configured by various other configurations of a drum, tape, and movable section.

Moreover, in the exemplary embodiment described above, explanation is given regarding the automated teller machine 1 as an example of the medium storage and feed-out device including: the customer interface 3 serving as an example of a customer interface; the conveyance section 13 serving as an example of a conveyance section; the drum 31 serving as an example of a drum; the upper side tape 33 and the lower side tape 36 serving as examples of tapes; and the movable section 40 serving as an example of a movable section.

However, the present invention is not limited thereto, and the medium storage and feed-out device may be configured by various other configurations of a customer interface, conveyance section, drum and movable section.

The present invention may be employed in various devices that temporarily hold a paper shaped medium, such as a banknote, wound onto a drum together with a tape.

The disclosure of Japanese Patent Application No. 2012-067209 is incorporated by reference in its entirety in the present specification. All cited documents, patent applications and technical standards mentioned in the present specification are incorporated by reference in the present specification to the same extent as if the individual cited document, patent application, or technical standard was specifically and individually indicated to be incorporated by reference.

The invention claimed is:

1. A medium storage and feed-out device, comprising:

a circular, cylinder-shaped drum that is rotatably supported, and that winds a medium onto an outer peripheral face of the drum to retain the medium between the outer peripheral face of the drum and a facing portion that faces the outer peripheral face of the drum;

a tape that has one end wound onto the drum outer peripheral face, and that, accompanying rotation of the drum, is wound with the medium supplied from the outside through an entry/exit hole on the drum outer peripheral face while the medium is sandwiched between the tape and the drum outer peripheral face; and a movable section, one end thereof being provided at the vicinity of the entry/exit hole, and the other end thereof extending to the vicinity of the drum, the movable section pressing the medium against the drum outer peripheral face while being movable with respect to the drum, with the other end of the movable section positioned further away from the drum than the facing portion, wherein:

the other end of the movable section is provided with a movable section claw that projects out toward the facing portion; and the facing portion is provided with a facing claw that projects out toward the other end of the movable section, the facing claw enmeshes with the movable section claw.

2. The medium storage and feed-out device of claim 1, wherein:

in the movable section, from a thinnest state in which a minimum quantity of the medium is wound onto the drum, through to a thickest state, in which a maximum quantity of the medium is wound onto the drum, the other end of the movable section is positioned so as to be further away from the drum than the facing portion.

3. The medium storage and feed-out device of claim 2, wherein:

in the thickest state, an angle of 30 degrees or less is formed between a travel direction in which the medium travels on feeding out from the drum, and the other end of the movable section that faces the drum.

4. The medium storage and feed-out device of claim 1, wherein:

the movable section is formed in a curved plate shape so as to cover the drum outer peripheral face from one side.

5. The medium storage and feed-out device of claim 4, wherein:

the movable section comprises a face that covers the drum outer peripheral face, the face of the movable section includes a flat face portion formed in a substantially flat plane shape, and is formed at further to the other end side from the flat face portion so as to form a circular arc with a greater radius of curvature than the drum outer peripheral face.

6. The medium storage and feed-out device of claim 4, wherein:

the movable section is formed so as to cover the drum from the upper side.

7. A medium transaction apparatus comprising:

a customer interface that accepts transactions relating to a medium;

a conveyance section that conveys the medium accepted by the customer interface;

a circular, cylinder-shaped drum that is rotatably supported, and that winds the medium onto an outer peripheral face of the drum to retain the medium between the outer peripheral face and a facing potion that faces the outer peripheral face;

a tape that has one end wound onto the drum outer peripheral face, and that, accompanying rotation of the drum, is wound with the medium supplied from the outside through an entry/exit hole on the drum outer peripheral face while the medium is sandwiched between the tape and the drum outer peripheral face; and a movable section, one end thereof being provided at the vicinity of the entry/exit hole, and the other end thereof extending to the vicinity of the drum, the movable section pressing the medium against the drum outer peripheral face while being movable with respect to the drum, with the other end of the movable section positioned further away from the drum than the facing portion, wherein:

the other end of the movable section is provided with a movable section claw that projects out toward the facing portion; and the facing portion is provided with a facing claw that projects out toward the other end of the movable section, the facing claw enmeshes with the movable section claw.

* * * * *